US005524346A

United States Patent [19]

Backhaus

[11] Patent Number: 5,524,346

[45] Date of Patent: Jun. 11, 1996

[54] SHAVING CARTRIDGE FOR WET RAZORS

[76] Inventor: Marc Backhaus, Laakbaum 15, D-42477 Radevormwald, Germany

[21] Appl. No.: 271,455

[22] Filed: Jul. 7, 1994

[30] Foreign Application Priority Data

Feb. 22, 1994 [DE] Germany ..... 44 05 576.5

[51] Int. Cl.[6] ..... B26B 21/22

[52] U.S. Cl. ..... 30/34.2; 30/50; 30/346.5

[58] Field of Search ..... 30/30, 34.2, 41, 30/49, 50, 77, 82, 346.5

[56] References Cited

U.S. PATENT DOCUMENTS 4,562,644 1/1986 Hichens ..... 30/77 A 5,191,712 3/1993 Crook et al. ..... 30/34.2

*Primary Examiner*—Douglas D. Watts

*Attorney, Agent, or Firm*—Jones & Askew

[57] ABSTRACT

According to the invention, the blade holder has a skin contact surface which is curved in a concave fashion in the moving direction of the razor. This design causes the skin to be curved in accordance with the contact surface while shaving thus achieving an upright alignment of the beard hairs.

12 Claims, 2 Drawing Sheets

SHAVING CARTRIDGE FOR WET RAZORS

Figure 1:
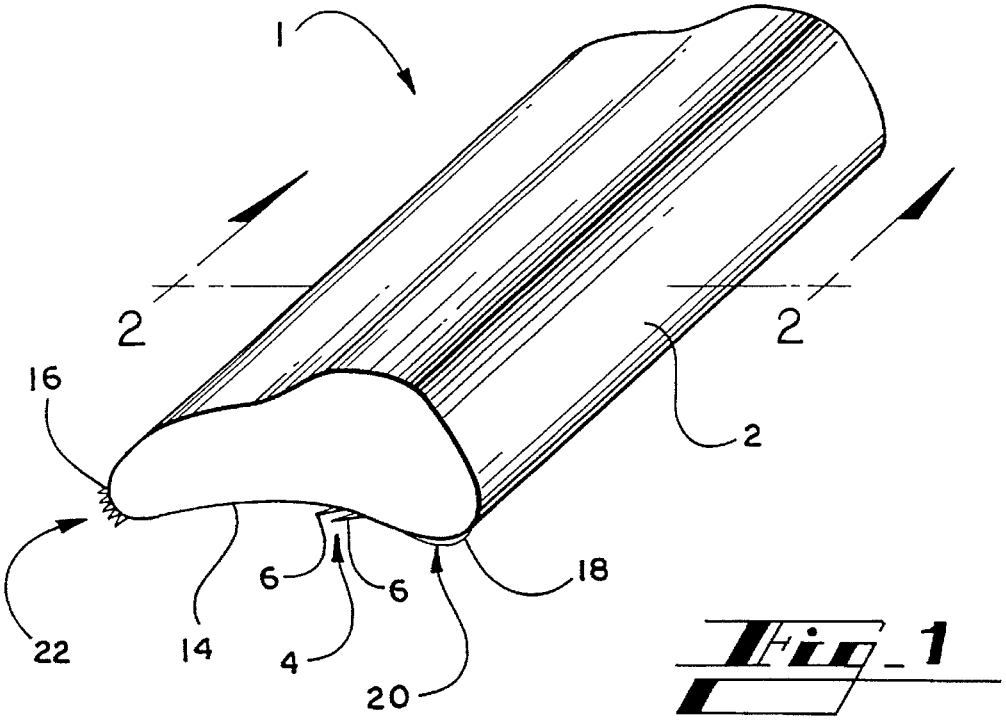

The present invention pertains to a shaving cartridge for wet razors consisting of a blade holder and a razor blade element retained therein.

When shaving with a wet razor, a known problem is to carry out the shave in such a way that it is thorough, but irritates the skin as little as possible.

There exist shaving cartridges of the generic type which attempt to achieve a thorough shave by designing the razor blade element as a double blade (so-called "tandem blades"), whereby the front blade viewed in the moving direction of the razor primarily is intended for positioning the beard hairs into an upright position for the ensuing second cut. Depending on the orientation and/or direction in which the beard hairs emerge from the skin, this may only be attained partially, mainly because the first blade tilts the beard hairs into the moving direction of the razor.

World Patent No. WO 92/17322 discloses a shaving cartridge of this type with a multiple blade arrangement comprising three individual blades. In this, the edges of the blades lie approximately in one collective plane with the contact regions of the blade holder.

U.S. Pat. No. 4,501,066 discloses a shaving system with a double cartridge, whereby two individual shaving cartridges are fastened onto one collective holder. Each of the two individual shaving cartridges comprises a double blade arrangement, but the blades of the two shaving cartridges are arranged in opposite directions. This measure is intended to achieve the desired shaving effect in both moving directions.

The present invention is based on the objective of improving a shaving cartridge of the generic type in such a way that an even more thorough, yet less irritating shave is facilitated.

According to the invention, the blade holder has a skin contact surface which is curved in an at least approximately concave fashion in the moving direction of the razor. This design according to the invention causes the skin to be curved in accordance with the contact surface while shaving, however in a convex fashion, whereby the aforementioned design surprisingly attains a particularly distinct "upright alignment effect" of the beard hairs. This means that one individual blade in principle would suffice. However, it is advantageous to provide a double or multiple blade which comprises at least two individual blades because this measure in association with the design of the holder according to the invention, i.e., the concave contact surface, attains a true combination effect, i.e., a "synergistic effect."

According to the invention, the blade and/or multiple blade is arranged approximately between the rear surface region and the central surface region of the concave contact surface viewed in the moving direction, in particular in the rear third and/or approximately at the transition between the central and the rear third of the contact surface. The edge(s) of the blade(s) preferably lies (lie) approximately within the region in which the summit of the skin curvature caused by the shaving cartridge according to the invention lies or within the region of the rear falling edge of this skin curvature.

The effect of the skin curvature in an advantageous development of the invention is influenced even more favorably by the fact that the rear region of the contact surface of the holder is provided with a strip-shaped friction element which extends parallel to the razor blade in such a way that an increased sliding friction between the holder and the skin is produced within this particular region. Due to this measure, the skin is practically pushed "in a corrugated fashion" by the rear region of the shaving cartridge according to the invention and consequently deformed in the direction of the blade(s). This means that the beard hairs are practically pushed into the region of the blades such that a particularly thorough shave may be attained.

Figure 2:
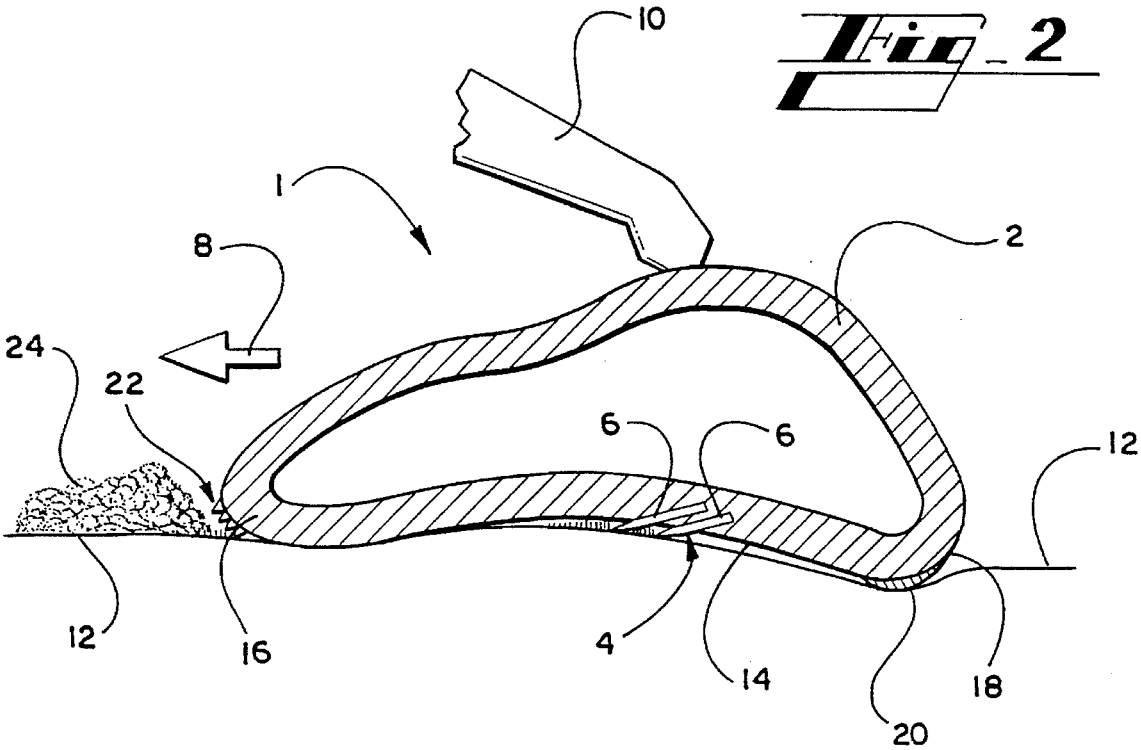
Figure 3:
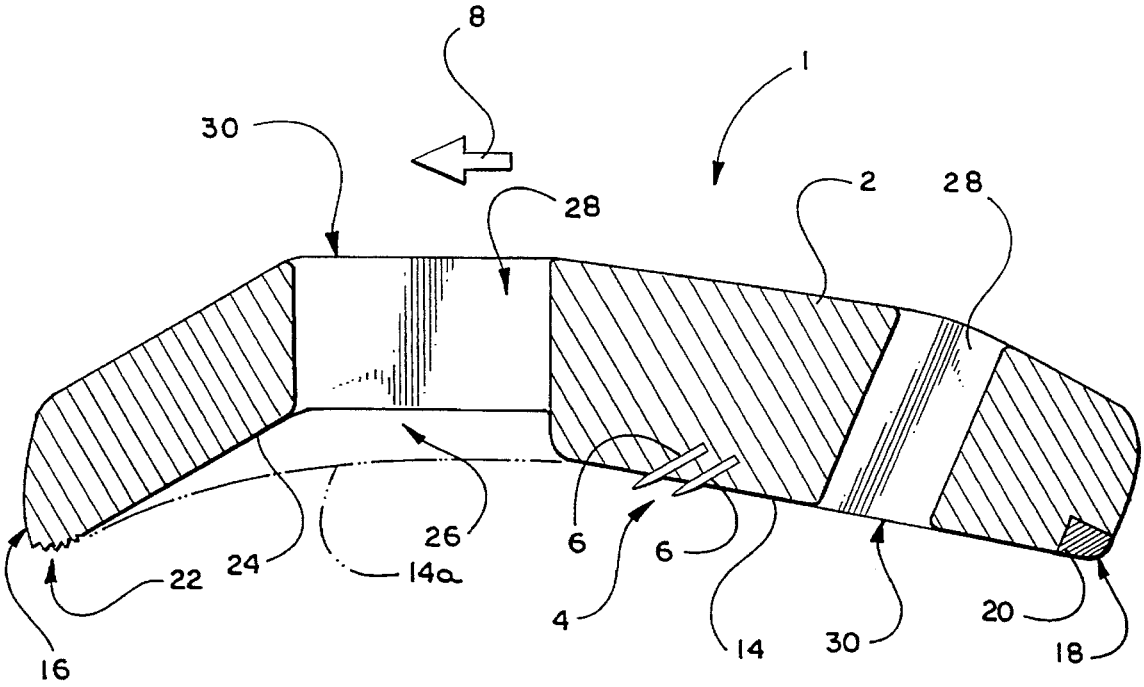

The invention is described in detail below with the aid of preferred embodiments illustrated in the figures. The figures show:

FIG. 1: a simplified, schematic representation of a perspective view of a shaving cartridge according to the invention, FIG. 2: an enlarged sectional representation along the line II—II in FIG. 1, namely to illustrate the function of the shaving cartridge while shaving, and FIG. 3: a view of an additional embodiment which is illustrated analogous to FIG. 2.

A shaving cartridge 1 for wet razors according to the invention consists of an oblong, strip-shaped blade holder 2 and a razor blade element 4 retained therein. In the embodiments illustrated in the figures, the razor blade element 4 is designed as a double blade comprising two parallel arranged individual razor blades 6. However, it is also possible to provide a multiple blade arrangement with three or even more individual blades 6. The at least two razor blades 6 are—in conventional fashion—arranged approximately like roof tiles, such that they overlap each other at a distance apart (see in particular FIG. 2).

When shaving—see FIG. 2—the holder 2 is aligned perpendicular to the moving direction 8 and pulled over the skin 12 in conventional fashion by means of the handle part 10, indicated only schematically in FIG. 2.

According to the invention, the blade holder 2 has a skin contact surface 14 which is curved in an at least approximately concave fashion viewed in the moving direction 8. The razor blade element 4 is arranged within the region of this concave contact surface 14, namely preferably within the region which extends from the rear to the center of this concave contact surface 14 viewed in the moving direction 8. In the preferred embodiments (see, for example, FIG. 2), the blades 6 are arranged approximately at the transition between the central and the rear third of the contact surface 14.

The approximately concave contact surface 14 preferably transforms gradually into a convex front curvature 16 and into a convex rear curvature 18. Consequently, the holder 2 has a cross-sectional shape that approximately corresponds to a kidney and/or a bean.

FIG. 2 shows that the skin 12 is curved in a convex fashion while shaving due to the concave curvature of the contact surface 14, so that the skin 12 is practically pushed toward the blades 4,6, thus causing the hairs to be aligned upright due to the skin curvature.

The previously described skin curvature may even be affected in a more favorable fashion by providing the rear region of the contact surface 14 of the holder 2 with a strip-shaped friction element 20 that extends parallel to the razor blade 4 and/or 6, in particular approximately in the transfer region between the contact surface 14 and the rear curvature 18. The friction element causes an increased sliding friction to be produced between the holder 2 and the skin 12 within this region. This friction element 20 preferably is formed of a strip consisting of an elastomer material, in particular rubber. Alternatively or additionally, the friction element 20 also may have a parallel fibbing (not shown in the figures).

It is advantageous if a parallel ribbing 22 or a similar structure which extends parallel to the blades 4 or 6 is arranged within the front region of the contact surface 14 and/or within the region of the front curvature 16. This advantageous measure in particular serves for distributing the shaving foam evenly (see FIG. 2).

The holder 2 may be connected with the handle part 10 in a separable fashion, preferably by means of a snap connection or a similar connection that is not illustrated in the figures.

According to FIG. 2, the holder 2 may be constructed as a hollow body which, in particular, consists of a plastic material. In this, the blade and/or double blade 4 preferably is embedded positively and/or nonpositively in the plastic material.

FIG. 3 shows an advantageous development of the shaving cartridge 1 according to the invention, whereby identical parts and/or components are identified by the same reference numerals as in the embodiments according to FIGS. 1 and 2, so that these parts do not have to be described anew. In this advantageous embodiment, it is suggested that the holder 2 is provided with a recess 24 that extends parallel to the razor blade element 4, namely within a region of the contact surface 14 which is situated in front of the razor blade element 4 or the razor blades 6 viewed in the moving direction 8 so as to form a free space 26 which interrupts the contact surface 14 within this region. In FIG. 3, the contact surface is indicated by broken lines and identified by the reference numeral 14*a*. This figure makes it clear that the skin curvature is affected favorably by the free space 26 according to the invention since the curved skin may be accommodated within the free space 26. This means that the skin may be curved practically unhindered in a convex fashion as it is desirable for aligning the beard hairs upright. The front region of the holder 2 only contacts the skin approximately in the shape of a line, as is also the case in the rear region of the blade element 4.

FIG. 3 shows one additional advantageous embodiment. According to this embodiment, the holder 2 is provided with several continuous slots and/or apertures 28 which extend parallel to the moving direction 8, namely within the regions situated in front of and/or behind the razor blade element 4 viewed in the moving direction 8, so that parallel connecting elements 30 arranged in the moving direction 8 remain within these regions. This advantageous embodiment allows the shaving cartridge 1 to be effectively rinsed with water after shaving so as to remove residual shaving foam as well as the beard hairs cut off during the shaving process.

The invention is not limited to the embodiments described and illustrated in the figures, but also includes all embodiments which function identically in the sense of the invention and are within the spirit and scope of the following claims.

What is claimed is:

1. Shaving cartridge for wet razors with a blade holder having a skin contact surface in the area in which a razor blade element having an edge is retained in the blade holder crosswise to the moving direction, comprising:

the skin contact surface of the blade holder extends at least approximately in a concave fashion in the moving direction such that the skin is curved in a convex fashion within the region of the skin contact surface while shaving and hairs on the skin are aligned upright;

the skin contact surface transforms gradually into a convex curvature; and the razor blade element is arranged approximately between a rear region of the contact surface and a central region of the contact surface viewed in the moving direction, whereby the edge of the blade clement lies substantially either within a region in which a summit of the skin curvature lies or within a region of a rear falling flank of the skin curvature.

2. Shaving cartridge according to claim 1, characterized by the fact that the approximately concave contact surface (14) transforms gradually into a convex front curvature (16).

3. Shaving cartridge according to claim 1, characterized by the fact that the approximately concave contact surface (14) transforms gradually into a convex rear curvature (18).

4. Shaving cartridge according to claim 1, characterized by the fact that the holder (2) is provided with a friction element (20) which extends parallel to the razor blade element (4) in the rear portion of contact surface (14), in particular approximately within the transition region between the contact surface (14) and the rear curvature (18), so that an increased sliding friction between the holder (2) and the skin is produced within this region.

5. Shaving cartridge according to claim 4, characterized by the fact that the friction element (20) is formed by a strip comprising an elastomer.

6. Shaving cartridge according to claim 4, characterized by the fact that the friction element (20) is provided with a parallel ribbing.

7. Shaving cartridge according to claim 2, characterized by the fact that a parallel ribbing (22) is arranged within a front region of the contact surface (14) and/or within the region of the front curvature (16).

8. Shaving cartridge according to claim 1, characterized by the fact that the holder (2) has an approximately kidney-shaped or bean-shaped cross section contour-viewed in a plane that extends perpendicular to its longitudinal extent.

9. Shaving cartridge according to claim 1, characterized by the fact that the razor blade element (4) which is retained in the holder (2) is designed as a plural blade (6) comprising at least two parallel razor blades (6).

10. Shaving cartridge according to claim 1, characterized by the fact that the holder (2) in particular may be connected with the handle part (10) in a separable fashion, preferably by means of a snap connection.

11. Shaving cartridge according to claim 1, characterized by the fact that the holder (2) is provided with a recess (24) which extends parallel to the razor blade element (4), namely within a region of the contact surface (14) which is situated in front of the razor blade element (4) viewed in the moving direction (8), so as to form a free space (26) which interrupts the contact surface.

12. Shaving cartridge according to claim 1, characterized by the fact that the holder (2) is provided with several continuous slots and/or apertures (28) which extend parallel to the moving direction (8), namely within the region which is situated in front of and/or behind the razor blade element (4) viewed in the moving direction (8).

* * * * *